United States Patent [19]

Pletts

[11] 4,216,654

[45] Aug. 12, 1980

[54] FUEL COMPONENT EXTRACTOR

[76] Inventor: Donald C. Pletts, 145 Ocean Ave., #502 Palm Beach Shores, Fla. 33404

[21] Appl. No.: 935,849

[22] Filed: Aug. 22, 1978

[51] Int. Cl.[2] ..... F02M 25/06

[52] U.S. Cl. ..... 60/311; 55/456; 123/568; 60/279

[58] Field of Search ..... 123/119 A; 60/311, 279; 55/456, 457

[56] References Cited

U.S. PATENT DOCUMENTS

| | | | |
|---|---|---|---|
| 2,025,362 | 12/1935 | Starr | 123/119 A |
| 2,147,671 | 2/1939 | Pratt | 123/119 A |
| 2,860,618 | 11/1958 | Mansfield | 123/119 A |
| 3,397,682 | 8/1968 | Rigan | 123/119 A |
| 3,435,810 | 4/1969 | Busse | 123/119 A |
| 3,495,385 | 2/1970 | Glass | 60/311 |
| 3,530,843 | 9/1970 | Fessenden | 123/119 A |
| 3,579,981 | 5/1971 | Gau | 123/119 A |
| 3,580,233 | 5/1971 | Busse | 123/119 A |

*Primary Examiner*—Wendell E. Burns
*Attorney, Agent, or Firm*—Sherman & Shalloway

[57] ABSTRACT

An exhaust extractor is disclosed in which a curvate path is provided for installation in the exhaust system of a vehicle and has an external chamber for receiving extracted fuel constituents of the exhaust for supply to the intake of the vehicle engine while precluding re-ingestion of undesirable particulate and pollutant matter. A main duct carries a plurality of inwardly-directed transfer scoops for interception and transfer of usable particulates and other fractions of the exhaust into the external chamber at selected portions of the periphery of the main duct away from the outer portion of the curvate path therein to minimize the transfer of heavy particulates or solids to the external chamber and the remainder of the exhaust recycle system.

3 Claims, 2 Drawing Figures

FUEL COMPONENT EXTRACTOR

BACKGROUND OF THE INVENTION

The present invention is concerned with the return of selected portions of exhaust gases from internal combustion engines for utilization in the forming of subsequent charges for the intake of the engine and is concerned, more particularly, with an extractor for the exhaust system which returns a high quantity of the usable exhaust fraction while passing the undesirable and problematical components through for discharge.

PRIOR ART STATEMENT AND DISCUSSION

The most relevant prior art of which I am aware comprising the following United States patents:

U.S. Pat. No. 3,435,810 to Busse;

U.S. Pat. No. 3,530,843 to Fessenden; and

U.S. Pat. No. 3,580,233 to Busse.

U.S. Pat. No. 3,435,810 discloses a separator for exhaust gases which imparts a whirling motion to the gases to establish relatively separate streams of heavier and lighter components so that the light-component stream can be recycled to the intake of the engine.

U.S. Pat. No. 3,530,843 discloses an exhaust separator which includes an axial tube centrally located within the unit to pass the central, heavier portion of the exhaust, while the more desirable portions thereof are withdrawn from the chamber surrounding the axial tube for supply to a charge-forming mixer at the engine intake.

U.S. Pat. No. 3,580,233 discloses a separator of the type disclosed in the Busse U.S. Pat. No. 3,435,810 in conjunction with a swirling mixer for the recycled exhaust.

The prior attempts at separation of desirable exhaust fractions, as represented by the above-listed patents, are functional and can be used to recycle exhaust gases to the intake of a combustion engine. However, none of the prior art devices achieves a selective separation and recycle of the most desirable constituents of the exhaust without either imposing a substantial back-pressure on the engine or, eventually, accumulating and then transferring undesirable solid portions of the exhaust.

In the separator disclosed in the Busse U.S. Pat. Nos. 3,435,810 and 3,580,233, the enforced swirling of the exhaust gases imposes a considerable back-pressure on the system so that, although the efficiency of the engine is partially improved by the recycle of portions of the exhaust, a substantial part of the increase is lost to the need to overcome the back-pressure imposed by the efficiency-improving attempt.

In the separator of the Fessenden patent, the chamber surrounding the central, axial pipe is subject to accumulation of solids and, eventually, transfer of those solids through the recycle system to the fuel/exhaust mixer with consequent blockage of susceptible portions of the system.

Therefore, the prior forms of exhaust separators have not been found to be satisfactory in all respects, since they either involve mechanical complexities and high pressure drops or, if they are mechanically simple in construction, they are subject to undesirable misoperation after a period of use.

SUMMARY OF THE INVENTION

In general, the preferred form of extractor of the present invention comprises an exhaust duct section which is curved on an arc and which is in communication with an external chamber via a plurality of relatively small, inwardly-deflected wall portions positioned along the inner portion of the wall, the outer portion of the wall being imperforate and forming a smooth path for the through-passage of the heavier portions of the exhaust, including the heavier particulate components.

OBJECTS OF THE INVENTION

It is an object of the present invention to provide an exhaust extractor for exhaust-recycle systems which is simple in structure, imposes no additional back-pressure on the engine, and is reliable in its extracting function over extended periods of usage.

It is another object of the present invention to provide a simple and reliable extractor for exhaust gases which will extract the usable exhaust portions for recycle with a minimum of the undesirable portions included.

It is another object of the present invention to provide a simple and reliable exhaust extractor which imposes a low back-pressure while imposing an inertial force on the exhaust components and passing the heavier portion of the constituents through the separator.

It is another object of the present invention to provide a simple and reliable exhaust extractor which imposes a low back-pressure while imposing an inertial force on the exhaust stream and intercepting and removing the lighter and usable constituents from the exhaust system.

BRIEF DESCRIPTION OF THE DRAWINGS

These and other objects of the invention and a better understanding thereof may be derived from the following description and the accompanying drawings, in which.

DETAILED DESCRIPTION OF THE PREFERRED EMBODIMENT

Figure 1:
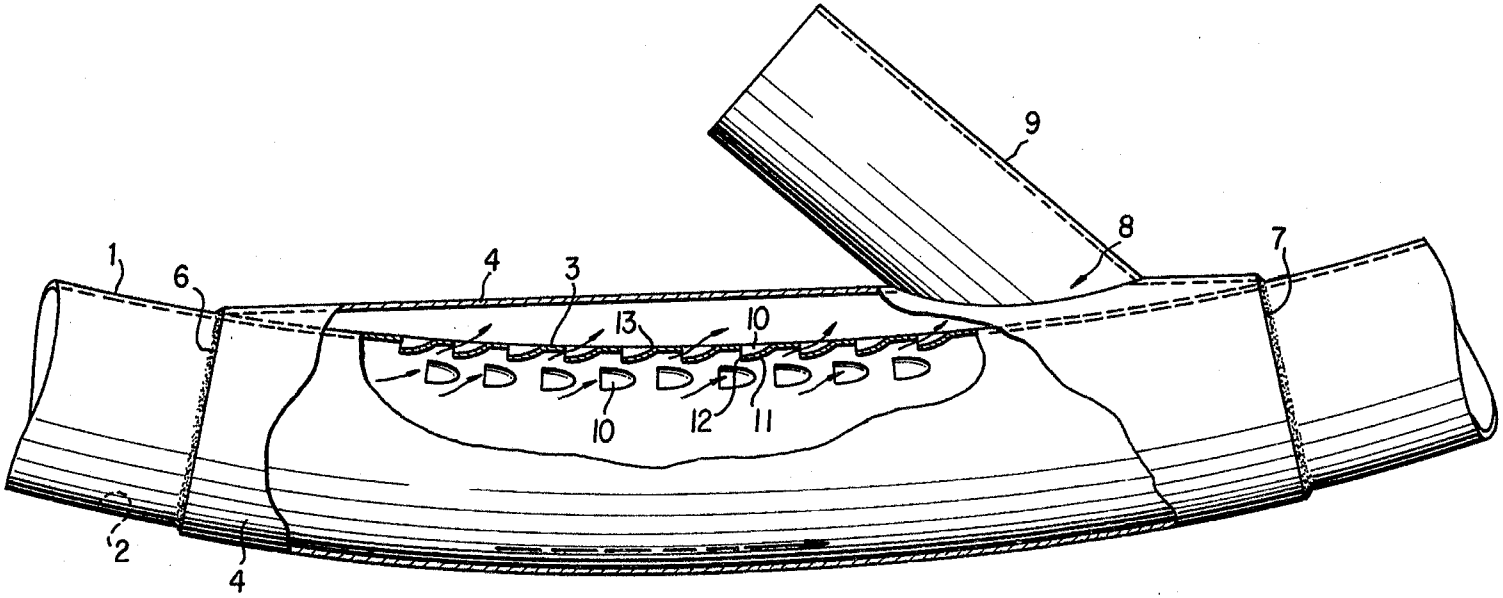
FIG. 1 is a side view, partly cut away, of the preferred form of exhaust extractor of the invention.
Figure 2:
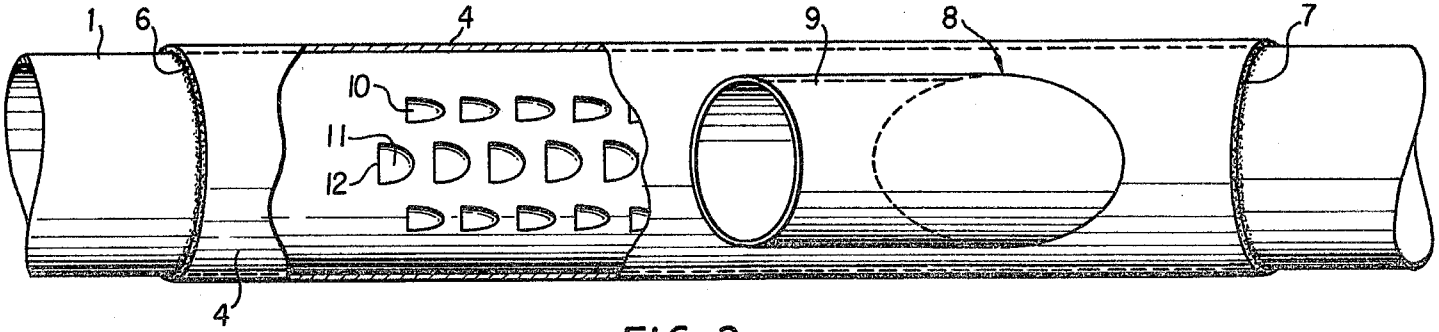
FIG. 2 is a top view, partly cut away, of a portion of FIG. 1.

As shown in the drawings, the preferred form of extractor is in the form of an insert for incorporation in the exhaust system of vehicles for their conversion with an exhaust-recycle system to improve their efficiency and emission performance. It is to be understood, however, that the extractor of the present invention is quite appropriate for use as original equipment in such systems.

A particularly advantageous system is disclosed in my copending application Ser. No. 775,834, filed Mar. 9, 1977, and titled "EXHAUST RECYCLE MIXER." The extractor of the present invention has been found to be especially effective with the mixer disclosed in that application, but it is to be understood that the new extractor of the present invention may be used in any exhaust recycling system which may be found effective.

The new extractor comprises a section of exhaust duct 1 which defines a relatively gently curved path and includes an outer curvate wall 2 and an inner curvate wall 3. A sleeve 4 of similar exhaust pipe material surrounds the curved portion of the duct 1 and is welded thereto at its ends 6 and 7 to form an external chamber 5 adjacent the inner wall 3. If desired, the chamber 5 may be formed by structure other than a sleeve, such as a U-shaped saddle, as long as a closed chamber is present along the inner wall 3. The chamber may include portions of the sidewalls toward the outer wall but is effective only in the region of the inner wall and the adjacent transition areas, as will be made apparent hereinafter. While the disclosed curvate form of duct is preferred, it is to be understood that other forms of fabrications may be employed as long as they provide a gently-curved, low back-pressure curvate flow path through the extractor.

The sleeve is provided with a takeoff aperture 8 in communication with the chamber 5 and a connector 9 for connection thereof with the exhaust/fuel mixer. The duct 1 carries a large number of small apertures 10 in its inner wall 3 which provide communication between the interior thereof and the external chamber 5 to transfer exhaust components to the chamber for recycle.

The apertures 10 preferably are formed by punching depressed wall portions 11 radially inwardly of the inner wall so that the depressed walls intercept exhaust components adjacent the inner wall for deflection into the chamber 5. It has been found advantageous to form the depressed portions with their leading edges 12 one-sixteenth to one-eighth of an inch inward from the inner surface 13 of the inner wall, and with an aperture size of about three-eighths of an inch in length and width, when the duct 1 is in the order of two and one-half inches diameter. While the foregoing dimensions are preferred for a duct of two and one-half inch diameter, it is to be understood that these dimensions may be varied for different-sized extractors. The resultant scoop or depressed wall portion thus forms a partially curvate delfector for the interception and removal of the desired exhaust portion of usable gases and light particulates.

In operation with exhaust gases flowing therethrough, as shown in FIG. 1, the heavier gases and solids are concentrated outwardly of the curve of the duct by inertia and tend to follow the outer wall 2 which, by reason of its being imperforate, channels these undesirable components toward the outlet and away from the chamber 5 without the imposition of complex vanes, swirlers or the like. The lighter gases and particulates which are appropriate for recycle and use in the engine are thus presented in the inner portion of the curved duct 1 and are intercepted by the depressed walls or scoops 11 and diverted into the chamber 5 for recycle via the connector 9 with a minimum of disturbance of the main flow of exhaust through the duct.

Therefore, it is apparent that the extractor of the present invention achieves its objects and provides an effective, selective extraction of the usable exhaust constituents without imposing high, self-defeating restrictions to flow, and consequent loss of engine efficiency.

Further, the new extractor has achieved its purpose in the reduction of recycled solids which tend to accumulate in the recycle system and to reduce the effectiveness of the system over long periods of usage.

Finally, it is apparent that the new extractor not only exceeds the prior units in its effectiveness and reliability, but also achieves its special advantages with an extremely simple structure free of complex diverters and of zones requiring servicing or periodic cleanout.

Various changes may be made in the details of the invention, as disclosed, without sacrificing the advantages thereof or departing from the scope of the appended claims.

What is claimed is:

1. An extractor for fuel components of an exhaust stream comprising:
   (a) a curved duct for exhaust gases, said duct defining
   (b) a curvate longitudinal interior flow path therethrough to impart a transverse inertial force on exhaust gases flowing longitudinally through said curvate flow path,
   (c) a chamber exterior of said curvate flow path,
   (d) transfer means for transferring fuel components from the inner arcuate portion of said curvate flow path to said chamber,
   (e) said transfer means including a plurality of apertures in said duct along the inner arcuate portion of said curvate flow path and
   (f) a deflector adjacent each aperture and extended into the inner arcuate portion of said curvate flow path, said deflectors being formed integrally with a wall of said duct and deformed therefrom to form said apertures.

2. The extractor of claim 1 in which said chamber encloses the area of said duct wall having the apertures therein.

3. An extractor for fuel components of an exhaust stream comprising:
   (a) a duct for exhaust gases, said duct including
   (b) a curvate wall portion at least partially defining the inner arcuate portion of a curvate flow path,
   (c) said curvate wall having
   (d) a plurality of deformed areas therein, said deformed areas each defining
      an aperture in said curvate wall and
      a deflector extended into an adjacent zone of said curvate flow path, and
   (e) a chamber formed at least in part by said curvate wall and adapted to receive fuel components of the exhaust stream via said apertures for transfer to an exhaust recycle system.

* * * * *